US010493337B2

(12) United States Patent
Kii

(10) Patent No.: US 10,493,337 B2
(45) Date of Patent: Dec. 3, 2019

(54) GOLF CLUB SET

(71) Applicant: SUMITOMO RUBBER INDUSTRIES, LTD., Kobe-shi, Hyogo (JP)

(72) Inventor: Kenji Kii, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/951,538

(22) Filed: Apr. 12, 2018

(65) Prior Publication Data

US 2018/0296883 A1 Oct. 18, 2018

(30) Foreign Application Priority Data

Apr. 14, 2017 (JP) ..... 2017-080525

(51) Int. Cl.
*A63B 53/04* (2015.01)

(52) U.S. Cl.
CPC .... *A63B 53/047* (2013.01); *A63B 2053/0408* (2013.01); *A63B 2053/0445* (2013.01)

(58) Field of Classification Search
USPC ..... 473/324–350
See application file for complete search history.

(56) References Cited

U.S. PATENT DOCUMENTS 2,784,969 A * 3/1957 Brandon ..... A63B 53/00 473/290
3,655,188 A * 4/1972 Solheim ..... A63B 53/04 473/290
4,147,349 A * 4/1979 Jeghers ..... A63B 53/04 473/291
4,247,105 A * 1/1981 Jeghers ..... A63B 53/04 473/291
4,840,380 A * 6/1989 Kajita ..... A63B 53/00 473/291
4,854,581 A * 8/1989 Long ..... A63B 53/00 473/290
5,056,788 A * 10/1991 Katayama ..... A63B 53/00 473/291
5,433,439 A * 7/1995 Hsien ..... A63B 53/04 473/290
5,547,426 A * 8/1996 Wood ..... A63B 53/04 473/290
6,089,990 A * 7/2000 Kimura ..... A63B 53/047 473/290

(Continued)

FOREIGN PATENT DOCUMENTS

JP 4546681 B2 9/2010

*Primary Examiner* — Alvin A Hunter
(74) *Attorney, Agent, or Firm* — Birch, Stewart, Kolasch & Birch LLP

(57) ABSTRACT

A golf club set 2 includes three or more golf clubs. A straight line passing through a face center Fc and parallel to a toe-heel direction is defined as an X-axis, and an X-coordinate of a sweet spot SS is defined as SS-X. When the SS-Xs of respective heads are defined as SS-X1, SS-X2, . . . , SS-Xn (n is an integer of equal to or greater than 3) in an ascending order of a loft angle from the head having the smallest loft angle, the set 2 satisfies the following formulas 1 and 2:

$$SS\text{-}X1 \geq SS\text{-}X2 \geq \ldots \geq SS\text{-}Xn \quad \text{(Formula 1);}$$

$$SS\text{-}X1 > SS\text{-}Xn \quad \text{(Formula 2).}$$

20 Claims, 3 Drawing Sheets

(56) References Cited

U.S. PATENT DOCUMENTS

| | | | | |
|---|---|---|---|---|
| 7,137,903 | B2 * | 11/2006 | Best | A63B 53/047 473/290 |
| 7,235,023 | B2 * | 6/2007 | Sugimoto | A63B 53/047 473/291 |
| 7,553,241 | B2 * | 6/2009 | Park | A63B 53/047 473/290 |
| 8,657,700 | B2 * | 2/2014 | Nicolette | A63B 53/047 473/291 |

* cited by examiner

GOLF CLUB SET

The present application claims priority on Patent Application No. 2017-80525 filed in JAPAN on Apr. 14, 2017, the entire contents of which are hereby incorporated by reference.

BACKGROUND OF THE INVENTION

Field of the Invention

The present invention relates to a golf club set.

Description of the Related Art

Japanese Patent No. 4546681 discloses a golf club set in which the greater a loft angle is, the smaller a distance of the center of gravity is.

SUMMARY OF THE INVENTION

As a result of extensive studies by the inventor of the present application, it has turned out that there is room for improvement in design of the centers of gravity based on distances of the centers of gravity in a golf club set.

The present disclosure provides a golf club set in which the design of the centers of gravity is improved.

In one aspect, a golf club set includes three or more golf clubs. Each of the golf clubs includes a head having a score line on a face surface, a shaft, and a grip. Each head has a face center determined based on a position of the score line, and a sweet spot determined based on a center of gravity of the head. In a front view of each head, a straight line passing through the face center and parallel to a toe-heel direction is defined as an X-axis, the face center is defined as an origin of the X-axis, and an X-coordinate of the sweet spot is defined as SS-X. The SS-Xs of the respective heads are defined as SS-X1, SS-X2, . . . , SS-Xn (n is an integer of equal to or greater than 3) in an ascending order of a loft angle from the head having the smallest loft angle. The set may satisfy the following formulas 1 and 2:

$$SS\text{-}X1 \geq SS\text{-}X2 \geq \ldots \geq SS\text{-}Xn \quad \text{(formula 1);}$$

$$SS\text{-}X1 > SS\text{-}Xn \quad \text{(formula 2).}$$

In another aspect, the set may satisfy the following formula 3:

$$SS\text{-}X1 > SS\text{-}X2 > \ldots > SS\text{-}Xn \quad \text{(formula 3).}$$

A distance between an axis line of the shaft and the center of gravity of the head is defined as a center-of-gravity distance B. The center-of-gravity distances B of the respective heads are defined as B1, B2, . . . , Bn (n is an integer of equal to or greater than 3) in an ascending order of the loft angle from the head having the smallest loft angle. In another aspect, the set may satisfy the following formulas 4 and 5:

$$B1 \geq B2 \geq \ldots \geq Bn \quad \text{(formula 4);}$$

$$B1 > Bn \quad \text{(formula 5).}$$

In another aspect, the set may satisfy the following formula 6:

$$B1 > B2 > \ldots > Bn \quad \text{(formula 6).}$$

In another aspect, the set may include a golf club A having a loft angle of equal to or greater than 15 degrees and equal to or less than 26 degrees, a golf club B having a loft angle of greater than 26 degrees and equal to or less than 36 degrees, and a golf club C having a loft angle of greater than 36 degrees. The SS-X of the golf club A is defined as SS-Xa, the SS-X of the golf club B is defined as SS-Xb, and the SS-X of the golf club C is defined as SS-Xc. The set may satisfy the following formula 7:

$$SS\text{-}Xa > SS\text{-}Xb > SS\text{-}Xc \quad \text{(formula 7).}$$

DESCRIPTION OF THE PREFERRED EMBODIMENTS

Hereinafter, preferable embodiments will be described in detail with appropriate references to the accompanying drawings.

Hereinafter, an iron type golf club set will be described as one embodiment of a golf club set. The golf club set may be a wood type golf club set, a hybrid type golf club set, or an iron type golf club set. The golf club set may also be a golf club set including various types of golf clubs such as wood type, hybrid type, and iron type golf clubs.

Definitions of Terms

The definitions of terms in the present application are as follows.

[Reference State]

The reference state is a state where a head is placed on a horizontal plane HP in a state where the horizontal plane HP and a score line gv are parallel to each other. In the reference state, a center axis line Z (axis line Z of a shaft) of a shaft hole of the head is provided in a reference perpendicular plane VP (see FIG. 3). The reference perpendicular plane VP is a plane perpendicular to the horizontal plane HP. In the reference state, the score line gv is parallel to the horizontal plane HP, and parallel to the reference perpendicular plane VP.

[Toe-Heel Direction]

Figure 3:
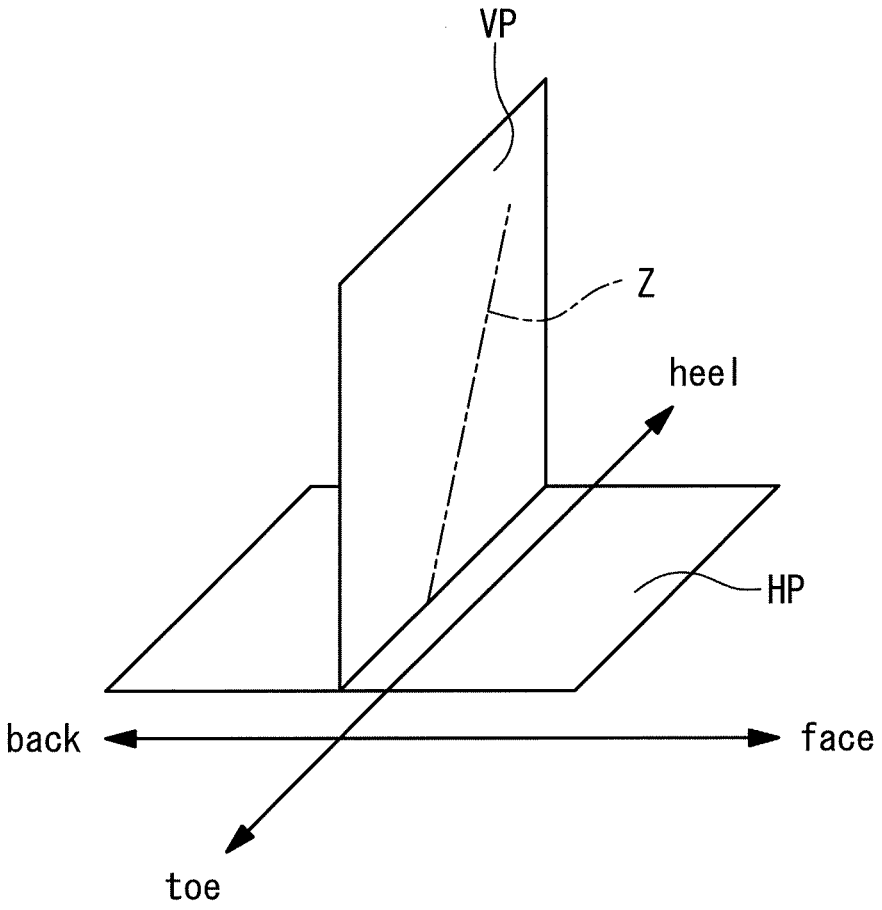
FIG. 3 is a perspective view showing a horizontal plane HP and a reference perpendicular plane VP in a reference state.

In the head of the reference state, the direction of an intersectional line between the reference perpendicular plane VP and the horizontal plane HP is the toe-heel direction (see FIG. 3). The toe-heel direction is parallel to the score line gv.

[Face-Back Direction]

A direction perpendicular to the toe-heel direction and parallel to the horizontal plane HP is the face-back direction (see FIG. 3). The face-back direction is also a front-rear direction. A face side is also referred to as a front side.

[Up-Down Direction]

A direction perpendicular to the toe-heel direction and perpendicular to the face-back direction is the up-down direction.

[Middle Position Pc of Score Line]

Figure 2:
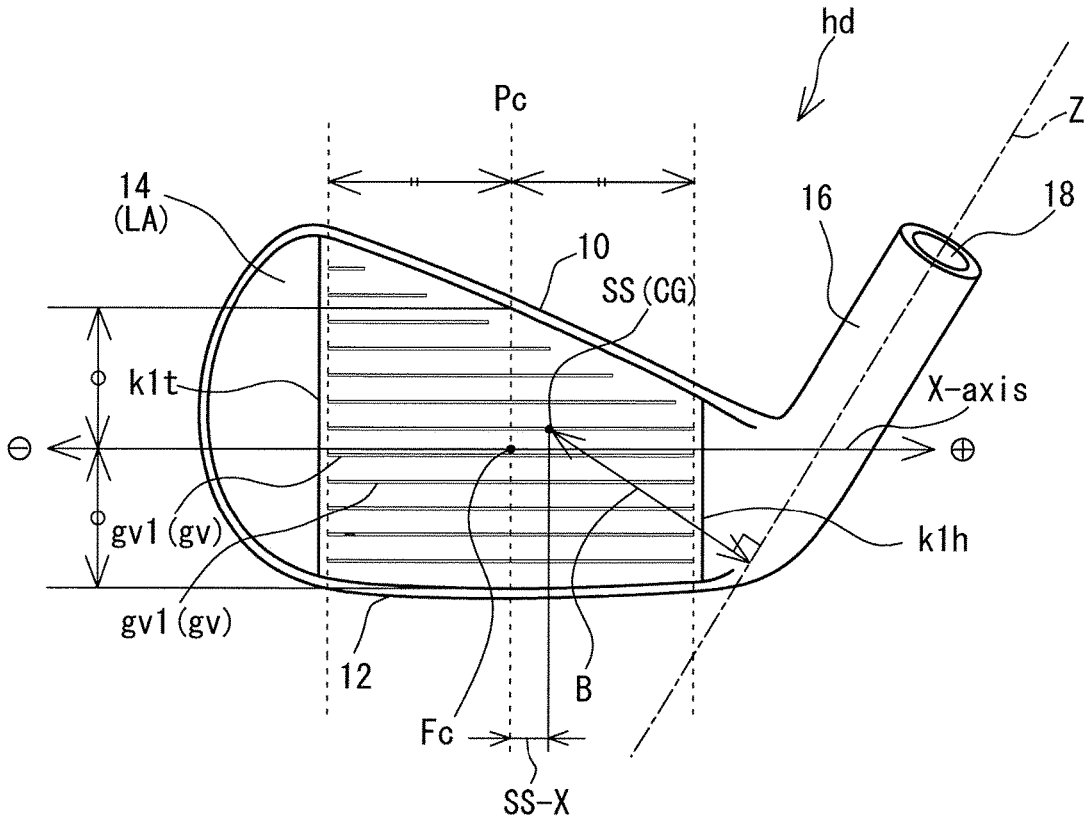
FIG. 2 is a front view of a head included in the set of FIG. 1, as viewed from the front of a face of the head.

The middle position of a longest score line gv1 in the toe-heel direction is a middle position Pc of the score line (see FIG. 2). The middle position Pc is a position in the toe-heel direction. When a plurality of longest score lines gv1 are present, the middle position Pc can be determined based on the lowermost longest score line gv1.

[Face Center Fc]

On the middle position Pc, a center point of the face surface in the up-down direction is determined. The center point in the up-down direction is the face center Fc (see FIG. 2).

[Sweet Spot SS]

The sweet spot SS is an intersection point between the face surface and a straight line passing through a center of gravity CG of the head and perpendicular to the face surface.

[SS-X]

In a front view, a line passing through the face center Fc and parallel to the toe-heel direction is defined as an X-axis (see FIG. 2). When the face center Fc is set as the origin of the X-axis, an X-coordinate of the sweet spot SS is represented by SS-X. When the sweet spot SS is located on a heel side relative to the face center Fc, the SS-X is a positive value. When the sweet spot SS is located on a toe side relative to the face center Fc, the SS-X is a negative value. The absolute value of the SS-X is equal to a toe-heel direction distance between the face center Fc and the sweet spot SS. The unit of the SS-X is mm.

[Center-of-Gravity Distance B]

A distance between the axis line Z of the shaft and the center of gravity CG of the head in the front view is the center-of-gravity distance B.

[Front View]

The front view means a projected figure projected on a plane parallel to the face surface. The projection plane is disposed in front of the face surface. The direction of the projection is a direction perpendicular to the face surface. FIG. 2 is the front view of a head hd. In this front view, the center of gravity CG of the head coincides with the sweet spot SS (see FIG. 2).

Figure 1:
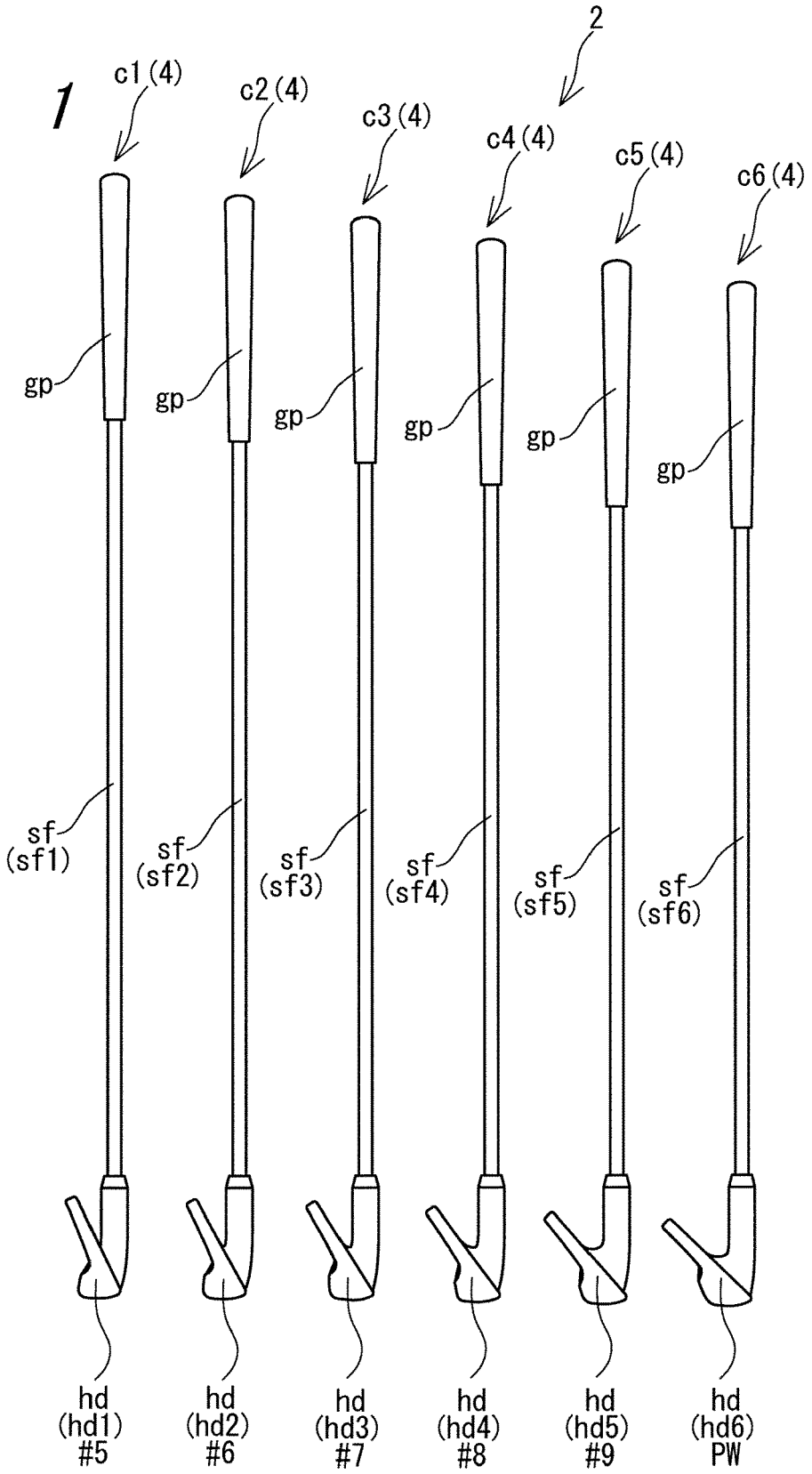
FIG. 1 shows a golf club set according to one embodiment of the present disclosure.

FIG. 1 shows a golf club set 2 according to one embodiment of the present disclosure. In the present application, a golf club set is also referred to as a golf club set, a club set, or a set. The set 2 is an iron type golf club set. An iron type golf club usually has a loft angle of 15 degrees or greater and 70 degrees or less. In the present application, the loft angle means a real loft angle. The real loft angle is a loft angle with respect to the axis line Z of the shaft.

The set 2 includes three or more golf clubs 4 having loft angles different from each other. The set 2 includes three or more golf clubs 4 having club lengths different from each other. The set 2 includes three or more golf clubs 4 having club lengths and loft angles different from each other. In the set 2, the loft angle is increased as the club length is decreased.

In the set 2, the number of the clubs is 6. The number of the clubs of the set 2 is equal to or greater than 3. As long as the number of the clubs of the set 2 is equal to or greater than 3, the number of the clubs of the set 2 is not limited. In light of enhancing advantageous effects to be described later, the number of the clubs of the set 2 is preferably equal to or greater than 3, more preferably equal to or greater than 4, still more preferably equal to or greater than 5, and yet still more preferably equal to or greater than 6. In the golf rules, the number of the clubs capable of being used in play is limited. In this respect, the number of the clubs of the set 2 is preferably equal to or less than 11, more preferably equal to or less than 10, and still more preferably equal to or less than 9.

Each of the golf clubs 4 includes a shaft sf, a head hd, and a grip gp. The head hd is attached to a tip end portion of the shaft sf. The grip gp is attached to a butt end portion of the shaft sf.

The set 2 includes golf clubs c1 to c6. The golf club c1 includes a shaft sf1, a head hd1, and a grip gp. The golf club c2 includes a shaft sf2, a head hd2, and a grip gp. The golf club c3 includes a shaft sf3, a head hd3, and a grip gp. The golf club c4 includes a shaft sf4, a head hd4, and a grip gp. The golf club c5 includes a shaft sf5, a head hd5, and a grip gp. The golf club c6 includes a shaft sf6, a head hd6, and a grip gp. The length of the shaft sf is decreased as the loft angle is increased.

The set 2 includes the golf club c1, the golf club c2, the golf club c3, the golf club c4, the golf club c5, and the golf club c6 in a descending order of a club length from the club having the longest club length. The club length is decreased as the loft angle is increased. In some or all of club numbers, the loft angles may be different, and the club lengths may be the same.

Although not illustrated in the drawings, in the set 2, a lie angle is increased as the club length is decreased.

In the set 2, club numbers of the respective clubs are as follows. The golf club c1 is a 5-iron; the golf club c2 is a 6-iron; the golf club c3 is a 7-iron; the golf club c4 is an 8-iron; the golf club c5 is a 9-iron; and the golf club c6 is a pitching wedge (PW). The club number of the golf club 4 included in the set 2 is not limited.

In the set 2, the club length is decreased as the club number is increased. The loft angle is increased as the club number is increased. A difference between the loft angles of the adjacent club numbers is usually 2 degrees or greater but 6 degrees or less.

In light of the advantageous effect of the set as described later, the set 2 preferably includes the following club A, club B, and club C:

[club A]: a golf club having a loft angle of 15 degrees or greater and 26 degrees or less;

[club B]: a golf club having a loft angle of greater than 26 degrees and 36 degrees or less; and

[club C]: a golf club having a loft angle of greater than 36 degrees.

Next, the heads used for the set 2 will be described. Hereinafter, matters common to all the club numbers are explained by regarding the heads as the head hd.

FIG. 2 is a front view of the head hd, as viewed from a direction perpendicular to a face surface. As shown in FIG. 2, the head hd has a top surface 10, a sole surface 12, a face surface 14, and a hosel 16. The face surface 14 is a surface hitting a ball. The sole surface 12 forms a bottom surface of the head hd. The sole surface 12 forms a surface projecting downward as a whole. The hosel 16 is positioned on a heel side of the head hd. The hosel 16 has a shaft hole 18. The center line of the shaft hole 18 coincides with the axis line Z of the shaft.

Although not shown in the drawing, a cavity (recess) is formed on a back surface of the head hd. The head hd is a so-called cavity back iron.

The material of the head hd is not limited. The head hd may be made of a metal, or may be made of a nonmetal. Examples of the metal include iron, stainless steel, maraging steel, pure titanium, and a titanium alloy. Examples of the iron include soft iron (a low carbon steel having a carbon content of less than 0.3 wt %). Examples of the nonmetal include CFRP (carbon fiber reinforced plastic). A plurality of materials may be combined. For example, the materials of a face portion and other portion may be different from each other.

The face surface 14 has a score line gv. The score line gv is also referred to as a face line or a face groove. The head hd has a plurality of score lines gv. Examples of a formation method of the score lines gv include forging, a press process, casting, and a cut process (carving). The plurality of score lines gv include the longest score line gv1.

A part of the face surface 14 is subjected to a treatment for adjusting a surface roughness. A typical example of the treatment is a shot-blasting treatment. In the present embodiment, the shot-blasting treatment is adopted. As shown in FIG. 2, a toe-side boundary line kit and a heel-side boundary line k1*h* are formed as boundaries between an area which is subjected to the shot-blasting treatment and an area which is not subjected to the shot-blasting treatment. An area between the boundary line k1*t* and the boundary line k1*h* is subjected to the shot-blasting treatment. All the score lines gv are formed in the area which is subjected to the shot-blasting treatment. An area on a toe side with respect to the toe-side boundary line kit is not subjected to the shot-blasting treatment. An area on a heel side with respect to the heel-side boundary line k1*h* is not subjected to the shot-blasting treatment. The toe-side boundary line k1*t* and the heel-side boundary line k1*h* are visually recognized by the absence or presence of the shot-blasting treatment. The surface roughness is increased by the shot-blasting treatment. The increased surface roughness can increase a back-spin rate.

The face surface 14 has a land area LA. The land area LA indicates a portion on which the score lines gv are not formed, of the face surface 14. When minute unevenness formed by the shot-blasting treatment or the like is disregarded, the land area LA is substantially a plane. Therefore, in the present application, the face surface 14 is treated as a plane. The head hd is an iron head. In an iron head, the face surface 14 is usually a plane.

The head hd has a face center Fc. As described above, the face center Fc is determined based on the position of the score line gv.

The head hd has the center of gravity CG of the head and the sweet spot SS. The sweet spot SS is determined based on the center of gravity CG of the head. The definition of the sweet spot SS is as described above. FIG. 2 shows the above-described front view. For this reason, in FIG. 2, the center of gravity CG of the head coincides with the sweet spot SS.

As shown in FIG. 2, in the face surface 14, a straight line passing through the face center and parallel to the toe-heel direction is defined as the X-axis. An X-coordinate is determined based on the X-axis. The origin of the X-coordinate is the face center Fc.

The X-coordinate of the sweet spot SS is SS-X. When the sweet spot SS is located on a heel side relative to the origin (face center Fc), the SS-X is a positive value. When the sweet spot SS is located on a toe side relative to the origin (face center Fc), the SS-X is a negative value. Therefore, as the position of the sweet spot SS is shifted to further heel side, the value of the SS-X becomes larger. In other words, as the position of the sweet spot SS is shifted to further toe side, the value of the SS-X becomes smaller.

In the present application, the SS-Xs of the respective heads included in the set 2 are defined as SS-X1, SS-X2, . . . , SS-Xn (n is an integer of equal to or greater than 3) in an ascending order of the loft angle from the head having the smallest loft angle.

In the present embodiment, the SS-X of the head hd1 is SS-X1, the SS-X of the head hd2 is SS-X2, the SS-X of the head hd3 is SS-X3, the SS-X of the head hd4 is SS-X4, the SS-X of the head hd5 is SS-X5, and the SS-X of the head hd6 is SS-X6.

The set 2 satisfies the following formulas 1 and 2:

$$SS\text{-}X1 \geq SS\text{-}X2 \geq \ldots \geq SS\text{-}Xn \quad \text{(formula 1);}$$

$$SS\text{-}X1 > SS\text{-}Xn \quad \text{(formula 2).}$$

In the present embodiment, the formula 1 is expressed as follows. The set 2 satisfies this formula.

$$SS\text{-}X1 \geq SS\text{-}X2 \geq SS\text{-}X3 \geq SS\text{-}X4 \geq SS\text{-}X5 \geq SS\text{-}X6$$

In the present embodiment, the formula 2 is expressed as follows. The set 2 satisfies this formula.

$$SS\text{-}X1 \geq SS\text{-}X6$$

The set 2 satisfies the following formula 3:

$$SS\text{-}X1 \geq SS\text{-}X2 \geq \ldots \geq SS\text{-}Xn \quad \text{(formula 3).}$$

In the present embodiment, the formula 3 is expressed as follows. The set 2 satisfies this formula.

$$SS\text{-}X1 \geq SS\text{-}X2 \geq SS\text{-}X3 \geq SS\text{-}X4 \geq SS\text{-}X5 \geq SS\text{-}X6$$

In the present embodiment, the greater the club number is (the greater the loft angle is), the smaller the SS-X is. In other words, as the club number becomes greater, the sweet spot SS is shifted to further toe side with respect to the face center Fc.

It has turned out that performances of respective club numbers can be optimized by adopting this design of the centers of gravity. The results are shown in Examples to be described later.

As described above, the distance between the axis line Z of the shaft and the center of gravity CG of the head in the front view is expressed as the center-of-gravity distance B. The center-of-gravity distances B of the respective heads of the set 2 are defined as B1, B2, . . . , Bn (n is an integer of equal to or greater than 3) in an ascending order of the loft angle from the head having the smallest loft angle.

In the present embodiment, the center-of-gravity distance B of the head hd1 is B1, the center-of-gravity distance B of the head hd2 is B2, the center-of-gravity distance B of the head hd3 is B3, the center-of-gravity distance B of the head hd4 is B4, the center-of-gravity distance B of the head hd5 is B5, and the center-of-gravity distance B of the head hd6 is B6.

The set 2 may satisfy the following formulas 4 and 5:

$$B1 \geq B2 \geq \ldots \geq Bn \quad \text{(formula 4);}$$

$$B1 > Bn \quad \text{(formula 5).}$$

In the present embodiment, the formula 4 is expressed as follows. The set 2 may satisfy this formula.

$$B1 \geq B2 \geq B3 \geq B4 \geq B5 \geq B6$$

In the present embodiment, the formula 5 is expressed as follows. The set 2 may satisfy this formula.

$$B1 > B6$$

Contrary to the formulas 4 and 5, the set 2 may satisfy the following formulas 4-1 and 5-1:

$$B1 \leq B2 \leq \ldots \leq Bn \quad \text{(formula 4-1);}$$

$$B1 < Bn \quad \text{(formula 5-1).}$$

The set 2 may satisfy the following formula 6:

$$B1 > B2 > \ldots > Bn \quad \text{(formula 6).}$$

In the present embodiment, the formula 6 is expressed as follows. The set 2 may satisfy this formula.

$$B1>B2>B3>B4>B5>B6$$

Contrary to the formula 6, the set 2 may satisfy the following formula 6-1:

$$B1<B2<\ldots<Bn \quad \text{(formula 6-1).}$$

In the set which satisfies the formulas 4 and 5, a club having a higher club number (club number having a larger loft angle) has a smaller center-of-gravity distance B. As shown in Examples to be described later, it has turned out that, as long as the SS-Xs satisfy the formulas 1 and 2, excellent results can be obtained in both cases where the center-of-gravity distance B is increased as the club number is increased, and where the center-of-gravity distance B is decreased as the club number is increased. When shapes of heads for an iron type set are designed so as not to cause a strange feeling for golfers, the center-of-gravity distance B is apt to be decreased as the club number is increased. In light of easiness of design, the set satisfying the formulas 4 and 5 is preferable, and the set satisfying the formula 6 is more preferable. In other words, in light of easiness of design, the center-of-gravity distance B is preferably decreased as the club number is increased.

A set can be configured so that the center of gravity CG of the head (sweet spot SS) is shifted to further toe side with respect to the face center Fc as the club number is increased, and the center of gravity CG of the head is shifted to further heel side with respect to the axis line Z of the shaft as the club number is increased. Example 2 to be described later corresponds to this configuration.

It has turned out that performances of respective club numbers can be optimized by adopting the above-described design of the centers of gravity for the SS-Xs. Specifically, it has turned out that a distance deviated from an aimed position (target) is reduced in respective club numbers. In addition, it has also turned out that hit feeling is improved in respective club numbers. These results are shown in Examples to be described later.

The reason why the excellent results are obtained by the design of the centers of gravity has not yet been found out. However, the reason is supposed as follows. In addressing, the score line gv is visually recognized by the golf player. Golf players tend to have an intention of trying to hit a ball at the center of the score line gv. For this reason, it is considered that the SS-X determined based on the position of the score line gv has a high correlation with a hit point. On the other hand, since the center of gravity CG of the head is apart from the axis line Z of the shaft (because of the presence of the center-of-gravity distance B), a complicated dynamic behavior, such as a toe-down phenomenon, occurs during swinging. Since the behavior of a golf club in swinging is complicated, the dynamic behavior is also complicated. By the dynamic behavior, the state of the club at impact can be different from the state of the club in addressing. In addition, it is considered that the dynamic behavior is varied with the club numbers. The dynamic behavior causes a discrepancy between an actual hit point and a golfer's intended hit point. It is supposed that, as a result of the intermingling of the golfer's intention and the dynamic behavior in swinging, the above-mentioned design of the centers of gravity achieves excellent effects.

The set 2 includes a golf club A having a loft angle of equal to or greater than 15 degrees and equal to or less than 26 degrees, a golf club B having a loft angle of greater than 26 degrees and equal to or less than 36 degrees, and a golf club C having a loft angle of greater than 36 degrees.

In the present embodiment, the golf club c1 (5-iron) is classified in the golf club A. In the present embodiment, the golf club c2 (6-iron), the golf club c3 (7-iron), and the golf club c4 (8-iron) are classified in the golf club B. In the present embodiment, the golf club c5 (9-iron) and the golf club c6 (pitching wedge) are classified in the golf club C.

The SS-X of the golf club A is represented by SS-Xa. The SS-X of the golf club B is represented by SS-Xb. The SS-X of the golf club C is represented by SS-Xc. The set 2 satisfies the following formula 7:

$$SS\text{-}Xa>SS\text{-}Xb>SS\text{-}Xc \quad \text{(formula 7).}$$

When the golf club A includes a plurality of golf clubs A, it is sufficient that any one of the golf clubs A satisfies the formula 7. When the golf club B includes a plurality of golf clubs B, it is sufficient that any one of the golf clubs B satisfies the formula 7. When the golf club C includes a plurality of golf clubs C, it is sufficient that any one of the golf clubs C satisfies the formula 7.

When at least one classification among the golf club A, the golf club B and the golf club C includes a plurality of golf clubs, the formula 7 is preferably satisfied even when any golf clubs are selected out of the respective classifications.

Since the set 2 which satisfies the formula 7 includes clubs having a wide range of loft angles, discrepancies in hit points caused by the variations of club numbers is apt to occur. The discrepancies are effectively suppressed by adopting the above-described design of the centers of gravity.

The club length of the golf club A is preferably equal to or greater than 37.5 inches and equal to or less than 39.0 inches. The club length of the golf club B is preferably equal to or greater than 36.0 inches and equal to or less than 38.0 inches. The club length of the golf club C is preferably equal to or greater than 35 inches and equal to or less than 36.5 inches.

In light of the result of hitting and feeling upon hitting, the SS-Xa is preferably equal to or greater than +0.5 mm and preferably equal to or less than +2.0 mm. When the golf club A includes the plurality of golf clubs A, all the golf clubs A preferably fall within this numeral range. In light of the result of hitting and feeling upon hitting, the SS-Xb is preferably equal to or greater than 0 mm and preferably equal to or less than +1.5 mm. When the golf club B includes the plurality of golf clubs B, all the golf clubs B preferably fall within this numeral range. In light of the result of hitting and feeling upon hitting, the SS-Xc is preferably equal to or greater than −0.5 mm and preferably equal to or less than +1.0 mm. When the golf club C includes the plurality of golf clubs C, all the golf clubs C preferably fall within this numeral range.

It has turned out that, in light of the result of hitting and feeling upon hitting, the difference between the maximum value and the minimum value of the SS-Xs is preferably small. The difference [(SS-X1)−(SS-Xn)] is preferably equal to or less than 1.0 mm, more preferably equal to or less than 0.9 mm, still more preferably equal to or less than 0.8 mm, and yet still more preferably equal to or less than 0.7 mm. In light of the result of hitting and feeling upon hitting, the difference [(SS-X1)−(SS-Xn)] is preferably equal to or greater than 0.1 mm, more preferably equal to or greater than 0.2 mm, and still more preferably equal to or greater than 0.3 mm.

In light of the result of hitting and feeling upon hitting, the SS-Xs of all the clubs constituting the set are preferably positive values.

EXAMPLES

Hereinafter, the effects of the present disclosure will be clarified by Examples. However, the present disclosure should not be interpreted in a limited way based on the description of the Examples.

Example 1

Bodies formed by casting and respective face members formed by forging were joined to each other by welding to to obtain six kinds of iron type golf club heads including a 5-iron through a pitching wedge. All of the club numbers were cavity back irons. A carbon shaft and a grip were attached to each of the heads to obtain an iron type golf club set including six clubs. Specifications of this Example 1 are shown in the below table 1.

Examples 2 to 4 and Comparative Examples 1 to 3

Golf club sets were obtained in the same manner as in Example 1 except that values of the SS-Xs and the center-of-gravity distances B were set as shown in the below table 1. Designs of the centers of gravity for these sets were attained by changing weight distributions of the heads based on the heads of Example 1. A small-diameter hole having an inner diameter smaller than a hosel hole was provided on the bottom surface of the hosel hole of each head. A weight saved by forming the small-diameter hole was redistributed to other parts of each head to adjust the position of the center of gravity of the head. Specifications of the Examples and Comparative Examples are shown in the below tables 1 and 2.

Common shafts, grips, club lengths, and loft angles were used in all Examples and Comparative Examples. The loft angles and club lengths for respective club numbers are shown in the below table 1.

The evaluation method is as follows.

[Distance of Deviation from Target]

Each of 20 testers conducted a test. The testers set up a distance from a hit point to a target based on flight distances in hitting with their own golf club set. Each tester hit a ball five times. A distance between a point at which the hit ball stopped and the target point was measured for each hitting. The average values of the distances are shown in the below tables 1 and 2 as distance of deviation from target.

[Evaluation of Feeling Upon Hitting]

Each of 20 testers conducted a test. Each tester hit a ball five times to evaluate to what extent the tester felt that the ball was hit at the sweet spot by giving a rating of 1 to 5 to the feeling. As the rating becomes higher, the tester more strongly felt that the ball was hit at the sweet spot. Thus, the higher the rating is, the higher the evaluation is. The average values of all the testers are shown in the below tables 1 and 2.

TABLE 1

Specifications and Evaluation Results of Examples

| Club number | | #5 | #6 | #7 | #8 | #9 | PW | Unit |
|---|---|---|---|---|---|---|---|---|
| Real Loft Angle | | 25.0 | 28.0 | 32.0 | 36.0 | 41.0 | 46.0 | deg. |
| Club Length | | 38.0 | 37.5 | 37.0 | 36.5 | 36.0 | 35.5 | inch |
| Ex. 1 | SS-X | 1.1 | 1.0 | 0.9 | 0.8 | 0.7 | 0.4 | mm |
| | Center-of-Gravity Distance B | 36.3 | 36.3 | 36.4 | 36.6 | 36.7 | 36.9 | mm |
| | Distance of Deviation from Target | 18.6 | 16.5 | 14.3 | 10.2 | 7.9 | 7.4 | yds. |
| | Evaluation of feeling upon hitting | 4.4 | 4.2 | 4.2 | 4.1 | 4.3 | 4.4 | pt. |
| Ex. 2 | SS-X | 1.3 | 1.2 | 1.0 | 0.9 | 0.8 | 0.6 | mm |
| | Center-of-Gravity Distance B | 37.0 | 36.8 | 36.8 | 36.5 | 36.4 | 36.1 | mm |
| | Distance of Deviation from Target | 19.0 | 17.1 | 15.0 | 10.0 | 8.0 | 7.2 | yds. |
| | Evaluation of feeling upon hitting | 4.2 | 4.1 | 3.9 | 4.0 | 3.8 | 4.2 | pt. |
| Ex. 3 | SS-X | 1.2 | 1.0 | 0.8 | 0.6 | 0.4 | 0.2 | mm |
| | Center-of-Gravity Distance B | 36.5 | 36.6 | 36.7 | 36.8 | 37.0 | 37.2 | mm |
| | Distance of Deviation from Target | 18.8 | 17.0 | 14.3 | 11.6 | 8.5 | 8.0 | yds. |
| | Evaluation of feeling upon hitting | 3.7 | 3.6 | 3.8 | 3.8 | 3.7 | 4.0 | pt. |
| Ex. 4 | SS-X | 1.3 | 1.1 | 0.9 | 0.6 | 0.3 | 0.0 | mm |
| | Center-of-Gravity Distance B | 36.1 | 36.3 | 36.6 | 36.8 | 37.0 | 37.3 | mm |
| | Distance of Deviation from Target | 20.8 | 19.1 | 16.8 | 12.1 | 10.4 | 9.3 | yds. |
| | Evaluation of feeling upon hitting | 3.3 | 3.5 | 3.7 | 3.4 | 3.5 | 3.9 | pt. |

TABLE 2

Specifications and Evaluation Results of Comparative Examples

| Club number | | #5 | #6 | #7 | #8 | #9 | PW | Unit |
|---|---|---|---|---|---|---|---|---|
| Real Loft Angle | | 25.0 | 28.0 | 32.0 | 36.0 | 41.0 | 46.0 | deg. |
| Club Length | | 38.0 | 37.5 | 37.0 | 36.5 | 36.0 | 35.5 | inch |
| Comp. Ex. 1 | SS-X | 2.9 | 3.0 | 3.0 | 3.1 | 3.2 | 3.2 | mm |
| | Center-of-Gravity Distance B | 35.8 | 36.0 | 36.2 | 36.3 | 36.4 | 36.8 | mm |
| | Distance of Deviation from Target | 23.2 | 20.1 | 15.6 | 12.3 | 10.0 | 8.9 | yds. |
| | Evaluation of feeling upon hitting | 3.3 | 3.2 | 3.0 | 3.1 | 3.2 | 3.2 | pt. |
| Comp. Ex. 2 | SS-X | 4.4 | 4.8 | 5.2 | 5.5 | 6.0 | 6.3 | mm |
| | Center-of-Gravity Distance B | 38.8 | 38.5 | 38.3 | 38.0 | 37.5 | 37.0 | mm |
| | Distance of Deviation from Target | 30.1 | 25.5 | 20.3 | 17.7 | 14.4 | 11.1 | yds. |
| | Evaluation of feeling upon hitting | 3.1 | 3.4 | 3.3 | 3.5 | 3.0 | 2.9 | pt. |
| Comp. Ex. 3 | SS-X | 1.3 | 2.0 | 2.8 | 2.9 | 2.4 | 3.1 | mm |
| | Center-of-Gravity Distance B | 36.4 | 36.3 | 36.5 | 36.4 | 36.3 | 36.6 | mm |
| | Distance of Deviation from Target | 18.5 | 17.7 | 16.8 | 15.5 | 13.2 | 9.8 | yds. |

TABLE 2-continued

| Specifications and Evaluation Results of Comparative Examples | | | | | | | |
|---|---|---|---|---|---|---|---|
| Club number | #5 | #6 | #7 | #8 | #9 | PW | Unit |
| Evaluation of feeling upon hitting | 4.2 | 3.9 | 3.4 | 3.2 | 3.2 | 3.2 | pt. |

As shown in the tables 1 and 2, Examples are highly evaluated as compared with Comparative Examples. From the evaluation results, the advantages of the present disclosure are apparent.

The present disclosure can be applied to all golf club sets such as wood type, hybrid type, and iron type golf club sets.

The above description is only illustrative and various changes can be made.

What is claimed is:

1. A golf club set comprising three or more golf clubs, wherein each of the golf clubs has a head having a score line on a face surface, a shaft, and a grip, each of the heads has a face center determined based on a position of the score line, and a sweet spot determined based on a center of gravity of the head, in a front view of each of the heads, a straight line passing through the face center and parallel to a toe-heel direction is defined as an X-axis, the face center is defined as an origin of the X-axis, and an X-coordinate of the sweet spot is defined as SS-X, the SS-Xs of the respective heads are defined as SS-X1, SS-X2, SS-Xn (n is an integer of equal to or greater than 3) in an ascending order of a loft angle from the head having the smallest loft angle, the golf club set satisfies the following formulas 1 and 2:

$$SS\text{-}X1 \geq SS\text{-}X2 \geq \ldots \geq SS\text{-}Xn \quad \text{(formula 1);}$$

$$SS\text{-}X1 > SS\text{-}Xn \quad \text{(formula 2), and}$$

a difference [(SS-X1)−(SS-Xn) is equal to or greater than 0.1 mm and equal to or less than 1.0 mm.

2. The golf club set according to claim 1, wherein the golf club set satisfies the following formula 3:

$$SS\text{-}X1 > SS\text{-}X2 > \ldots > SS\text{-}Xn \quad \text{(formula 3).}$$

3. The golf club set according to claim 1, wherein in the front view of each of the heads, a distance between an axis line of the shaft and the center of gravity of the head is defined as a center-of-gravity distance B, the center-of-gravity distances B of the respective heads are defined as B1, B2, . . . , Bn (n is an integer of equal to or greater than 3) in the ascending order of the loft angle from the head having the smallest loft angle, and the golf club set satisfies the following formulas 4 and 5:

$$B1 \geq B2 \geq \ldots \geq Bn \quad \text{(formula 4);}$$

$$B1 > Bn \quad \text{(formula 5).}$$

4. The golf club set according to claim 3, wherein the golf club set satisfies the following formula 6:

$$B1 > B2 > \ldots > Bn \quad \text{(formula 6).}$$

5. The golf club set according to claim 1 comprising: a golf club A having a loft angle of equal to or greater than 15 degrees and equal to or less than 26 degrees; a golf club B having a loft angle of greater than 26 degrees and equal to or less than 36 degrees; and a golf club C having a loft angle of greater than 36 degrees, wherein the SS-X of the golf club A is defined as SS-Xa, the SS-X of the golf club B is defined as SS-Xb, and the SS-X of the golf club C is defined as SS-Xc, and the golf club set satisfies the following formula 7:

$$SS\text{-}Xa > SS\text{-}Xb > SS\text{-}Xc \quad \text{(formula 7).}$$

6. A golf club set comprising three or more golf clubs, wherein the golf club set includes a golf club A having a loft angle of equal to or greater than 15 degrees and equal to or less than 26 degrees; a golf club B having a loft angle of greater than 26 degrees and equal to or less than 36 degrees; and a golf club C having a loft angle of greater than 36 degrees, each of the golf clubs includes a head having a score line on a face surface, a shaft, and a grip, each of the heads has a face center determined based on a position of the score line, and a sweet spot determined based on a center of gravity of the head, in a front view of each of the heads, a straight line passing through the face center and parallel to a toe-heel direction is defined as an X-axis, the face center is defined as an origin of the X-axis, an X-coordinate of the sweet spot is defined as SS-X, the SS-X of the golf club A is defined as SS-Xa, the SS-X of the golf club B is defined as SS-Xb, and the SS-X of the golf club C is defined as SS-Xc, the golf club set satisfies the following formula 7:

$$SS\text{-}Xa > SS\text{-}Xb > SS\text{-}Xc \quad \text{(formula 7),}$$

the golf club A has a club length of equal to or greater than 37.5 inches and equal to or less than 39.0 inches, the golf club B has a club length of equal to or greater than 36.0 inches and equal to or less than 38.0 inches, and the golf club C has a club length of equal to or greater than 35 inches and equal to or less than 36.5 inches.

7. The golf club set according to claim 6, wherein the SS-Xa is equal to or greater than +0.5 mm and equal to or less than +2.0 mm.

8. The golf club set according to claim 6, wherein the golf club set comprises a plurality of golf clubs A, and in all the golf clubs A, the SS-Xa is equal to or greater than +0.5 mm and equal to or less than +2.0 mm.

9. The golf club set according to claim 6, wherein the SS-Xb is equal to or greater than 0 mm and equal to or less than +1.5 mm.

10. The golf club set according to claim 6, wherein the golf club set comprises a plurality of golf clubs B, and in all the golf clubs B, the SS-Xb is equal to or greater than 0 mm and equal to or less than +1.5 mm.

11. The golf club set according to claim 6, wherein the SS-Xc is equal to or greater than −0.5 mm and equal to or less than +1.0 mm.

12. The golf club set according to claim 6, wherein the golf club set comprises a plurality of golf clubs C, and in all the golf clubs C, the SS-Xc is equal to or greater than −0.5 mm and equal to or less than +1.0 mm.

13. The golf club set according to claim 6, wherein in the front view of each of the heads, a distance between an axis line of the shaft and the center of gravity of the head is defined as a center-of-gravity distance B, the center-of-gravity distances B of the respective heads are defined as B1, B2, . . . , Bn (n is an integer of equal to or greater than 3) in the ascending order of the loft angle from the head having the smallest loft angle, and the golf club set satisfies the following formulas 4 and 5:

$$B1 \geq Bn \geq \ldots \geq Bn \quad \text{(formula 4);}$$

$$B1 > Bn \quad \text{(formula 5).}$$

14. The golf club set according to claim 13, wherein the golf club set satisfies the following formula 6:

$$B1 > B2 > \ldots > Bn \quad \text{(formula 6).}$$

15. A golf club set comprising three or more golf clubs, wherein the golf club set includes a golf club A having a loft angle of equal to or greater than 15 degrees and equal to or less than 26 degrees; a golf club B having a loft angle of greater than 26 degrees and equal to or less than 36 degrees; and a golf club C having a loft angle of greater than 36 degrees, each of the golf clubs includes a head having a score line on a face surface, a shaft, and a grip, each of the heads has a face center determined based on a position of the score line, and a sweet spot determined based on a center of gravity of the head, in a front view of each of the heads, a straight line passing through the face center and parallel to a toe-heel direction is defined as an X-axis, the face center is defined as an origin of the X-axis, an X-coordinate of the sweet spot is defined as SS-X, the SS-X of the golf club A is defined as SS-Xa, the SS-X of the golf club Bis defined as SS-Xb, and the SS-X of the golf club C is defined as SS-Xc, the golf club set satisfies the following formula 7:

$$SS\text{-}Xa > SS\text{-}Xb > SS\text{-}Xc \quad \text{(formula 7), and}$$

the SS-Xb is equal to or greater than 0 mm and equal to or less than +1.5 mm.

16. The golf club set according to claim 15, wherein in the front view of each of the heads, a distance between an axis line of the shaft and the center of gravity of the head is defined as a center-of-gravity distance B, the center-of-gravity distances B of the respective heads are defined as B1, B2, . . . , Bn (n is an integer of equal to or greater than 3) in the ascending order of the loft angle from the head having the smallest loft angle, and the golf club set satisfies the following formulas 4 and 5:

$$B1 \geq B2 \geq \ldots \geq Bn \quad \text{(formula 4);}$$

$$B1 > Bn \quad \text{(formula 5).}$$

17. The golf club set according to claim 16, wherein the golf club set satisfies the following formula 6:

$$B1 > B2 >> Bn \quad \text{(formula 6).}$$

18. A golf club set comprising three or more golf clubs, wherein the golf club set includes a golf club A having a loft angle of equal to or greater than 15 degrees and equal to or less than 26 degrees; a golf club B having a loft angle of greater than 26 degrees and equal to or less than 36 degrees; and a golf club C having a loft angle of greater than 36 degrees, each of the golf clubs includes a head having a score line on a face surface, a shaft, and a grip, each of the heads has a face center determined based on a position of the score line, and a sweet spot determined based on a center of gravity of the head, in a front view of each of the heads, a straight line passing through the face center and parallel to a toe-heel direction is defined as an X-axis, the face center is defined as an origin of the X-axis, an X-coordinate of the sweet spot is defined as SS-X, the SS-X of the golf club A is defined as SS-Xa, the SS-X of the golf club B is defined as SS-Xb, and the SS-X of the golf club C is defined as SS-Xc, the golf club set satisfies the following formula 7:

$$SS\text{-}Xa > SS\text{-}Xb > SS\text{-}Xc \quad \text{(formula 7), and}$$

the SS-Xc is equal to or greater than −0.5 mm and equal to or less than +1.0 mm.

19. The golf club set according to claim 18, wherein in the front view of each of the heads, a distance between an axis line of the shaft and the center of gravity of the head is defined as a center-of-gravity distance B, the center-of-gravity distances B of the respective heads are defined as B1, B2, . . . , Bn (n is an integer of equal to or greater than 3) in the ascending order of the loft angle from the head having the smallest loft angle, and the golf club set satisfies the following formulas 4 and 5:

$$B1 \geq B2 \geq \ldots \geq Bn \quad \text{(formula 4);}$$

$$B1 > Bn \quad \text{(formula 5).}$$

20. The golf club set according to claim 19, wherein the golf club set satisfies the following formula 6:

$$B1 > B2 > \ldots > Bn \quad \text{(formula 6).}$$

* * * * *